US007833613B1

(12) United States Patent
Rometti

(10) Patent No.: US 7,833,613 B1
(45) Date of Patent: Nov. 16, 2010

(54) GRADE BOARD WITH INTEGRALLY FORMED LEDGE

(75) Inventor: Mark Rometti, Eau Claire, WI (US)

(73) Assignee: Menard, Inc., Eau Claire, WI (US)

( * ) Notice: Subject to any disclaimer, the term of this patent is extended or adjusted under 35 U.S.C. 154(b) by 389 days.

(21) Appl. No.: 11/399,639

(22) Filed: Apr. 6, 2006

(51) Int. Cl.
*B32B 27/00* (2006.01)

(52) U.S. Cl. ..... 428/212; 428/57; 428/33; 428/192; 428/342; 428/398; 428/541

(58) Field of Classification Search ..... 428/57, 428/34.1, 33, 192, 212, 342, 398, 541
See application file for complete search history.

(56) References Cited

U.S. PATENT DOCUMENTS 5,516,472 A 5/1996 Laver
6,153,293 A 11/2000 Dahl et al.
6,210,616 B1 4/2001 Suwanda
6,295,778 B1 * 10/2001 Burt ..... 52/592.6
6,590,004 B1 * 7/2003 Zehner ..... 521/84.1
6,692,815 B2 2/2004 Edgman
6,708,504 B2 * 3/2004 Brandt et al. ..... 62/63
6,780,359 B1 8/2004 Zehner et al.
6,942,829 B2 * 9/2005 Drabeck et al. ..... 264/176.1
6,958,185 B1 * 10/2005 Zehner ..... 428/317.9
6,971,211 B1 * 12/2005 Zehner ..... 52/518
6,984,676 B1 * 1/2006 Brandt ..... 524/13
2003/0077399 A1 4/2003 Saunders, Jr. et al.
2003/0087996 A1 5/2003 Hutchison et al.

* cited by examiner

*Primary Examiner*—David R Sample
*Assistant Examiner*—Lawrence D Ferguson
(74) *Attorney, Agent, or Firm*—Merchant & Gould P.C.

(57) ABSTRACT

A grade board with an integrally formed ledge projecting outwardly from the board. The board may be made of a polymeric and cellulosic composite.

1 Claim, 6 Drawing Sheets

GRADE BOARD WITH INTEGRALLY FORMED LEDGE

FIELD OF THE INVENTION

The present invention relates to a grade board with an integrally formed ledge for use during the construction of a structure. The board may be an extruded composite board fabricated from a polymeric and cellulosic composite.

BACKGROUND OF THE INVENTION

Construction of post frame structures involves setting upright wooden posts in holes bored in the ground around the perimeter of the structure. Typically, the posts are spaced approximately eight feet apart. At a pre-determined grade level, a grade board is installed spanning the distance between adjacent posts and extending the full perimeter of the structure. Exterior trim resting on at least a portion of the grade board is affixed to the exterior of the building to form the exterior walls of the structure. Post frame structures typically include, among others, sheds, garages, trailer skirting, industrial, manufacturing, warehousing, storage, hangars, distribution centers, churches, arenas, sports barns, agricultural buildings, or other large building structures.

Known grade boards are fabricated using two components. The first component is a wood board. The second component is a steel trim support member affixed to the wood board. Several disadvantages exist as a result of the non-unitary, multi-sectional fabrication of these grade boards.

One such disadvantage is that the grade board is made of two pieces, specifically, the wood board and the steel trim member. Therefore, the fabrication of this type of board is more complex and costly and there exists a need for a grade board that is of unitary construction. Many structural problems are attributed to the use of a board with two pieces.

The present invention is provided to solve the problems discussed above and other problems, and to provide advantages and aspects not provided by prior grade boards. A full discussion of the features and advantages of the present invention is deferred to the following detailed description, which proceeds with reference to the accompanying drawings.

SUMMARY OF THE INVENTION

The present invention relates to a grade board with an integrally formed ledge. In one embodiment of the present invention, an extruded composite grade board has an integrally formed ledge formed integral with the body of the board.

In another embodiment, an extruded grade board may have at least one hollow portion within the body. In addition, at least one fastener guide may be disposed on the board. As another embodiment, at least one fastener guide may correspond to the hollow portion within the body of the extruded grade board.

In yet another embodiment, a recess may be formed or disposed on the bottom surface of the extruded composite grade board. The recess is dimensioned to receive a tongue member portion of a separate, extruded composite support board.

In still another embodiment, the extruded composite grade board may be made of a polymer or a blend of polymers and cellulosic material.

In another embodiment, a polymeric skin encases the body. The polymeric skin may be made of the same polymer as the extruded composite grade board.

The present invention also relates to an extruded composite support board having a tongue member integral to the body which projects outwardly from the top surface of the body. The tongue member is dimensioned to engage a recess of the extruded composite grade board or another support board. A recess is disposed on the bottom surface of the extruded composite support board and is dimensioned to receive a tongue member portion of a second extruded composite support board.

In another embodiment, an extruded composite support board may have at least one hollow portion within the body. In addition, a fastener guide may be disposed on the side surface. As another embodiment, at least one fastener guide may correspond to the hollow portion within the body of the extruded support board.

In still another embodiment, the extruded composite support board may be made of a polymer or a blend of polymers and cellulosic material.

In yet another embodiment, a polymeric skin may encase the body. The skin may be made of the same polymer as the extruded composite support board.

Additional features, advantages and embodiments of the present invention are described in, and will be apparent from, the detailed description and the drawings.

DETAILED DESCRIPTION

Figure 1:
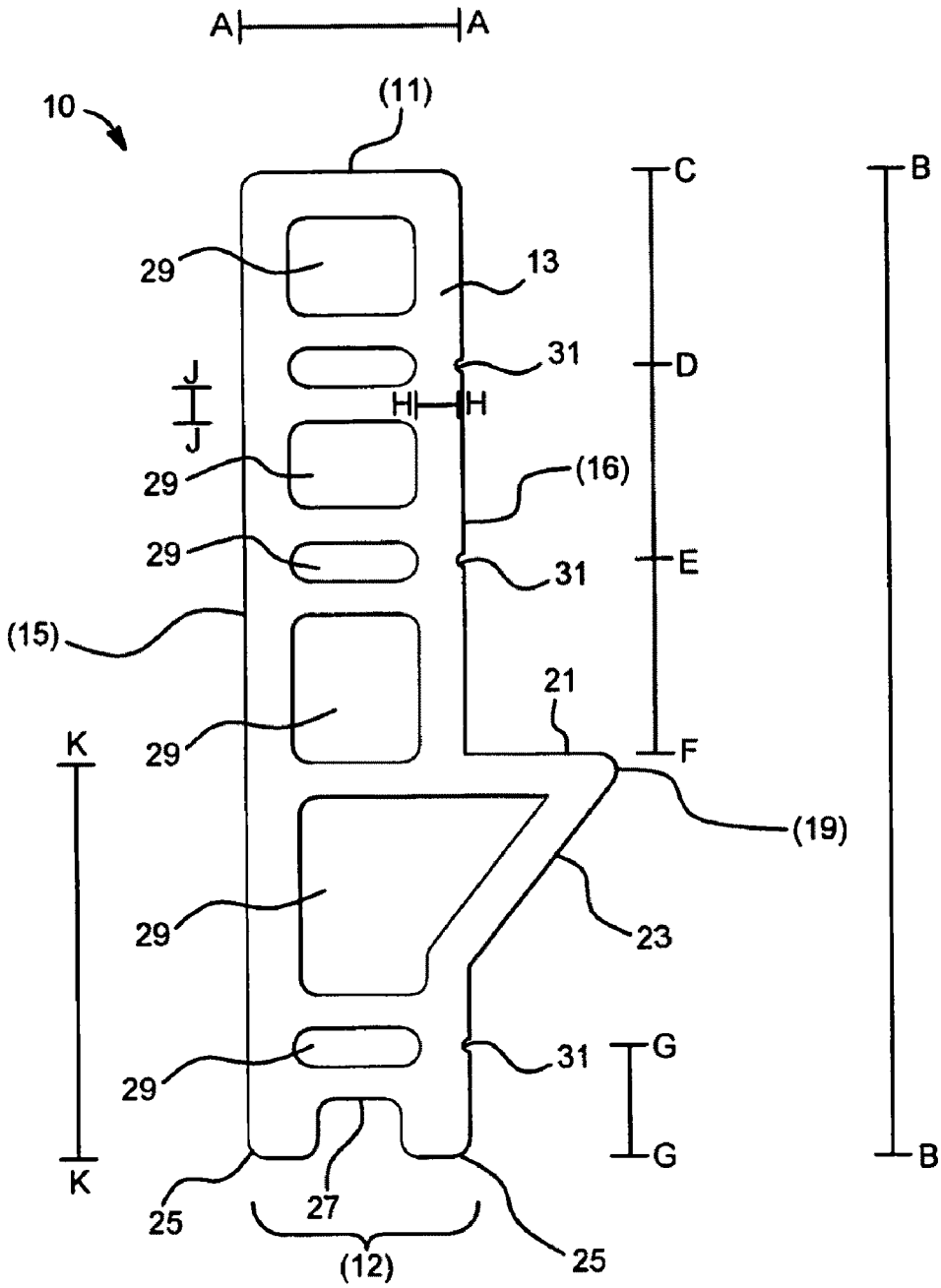
FIG. 1 illustrates a cross-sectional side view of an extruded composite grade board.

While this invention is susceptible of embodiments in many different forms, there is shown in the drawings and will herein be described in detail, examples of the invention with the understanding that the present disclosure is to be considered as an exemplification of the principles of the invention and is not intended to limit the broad aspect of the invention to the examples illustrated.

Figure 3:
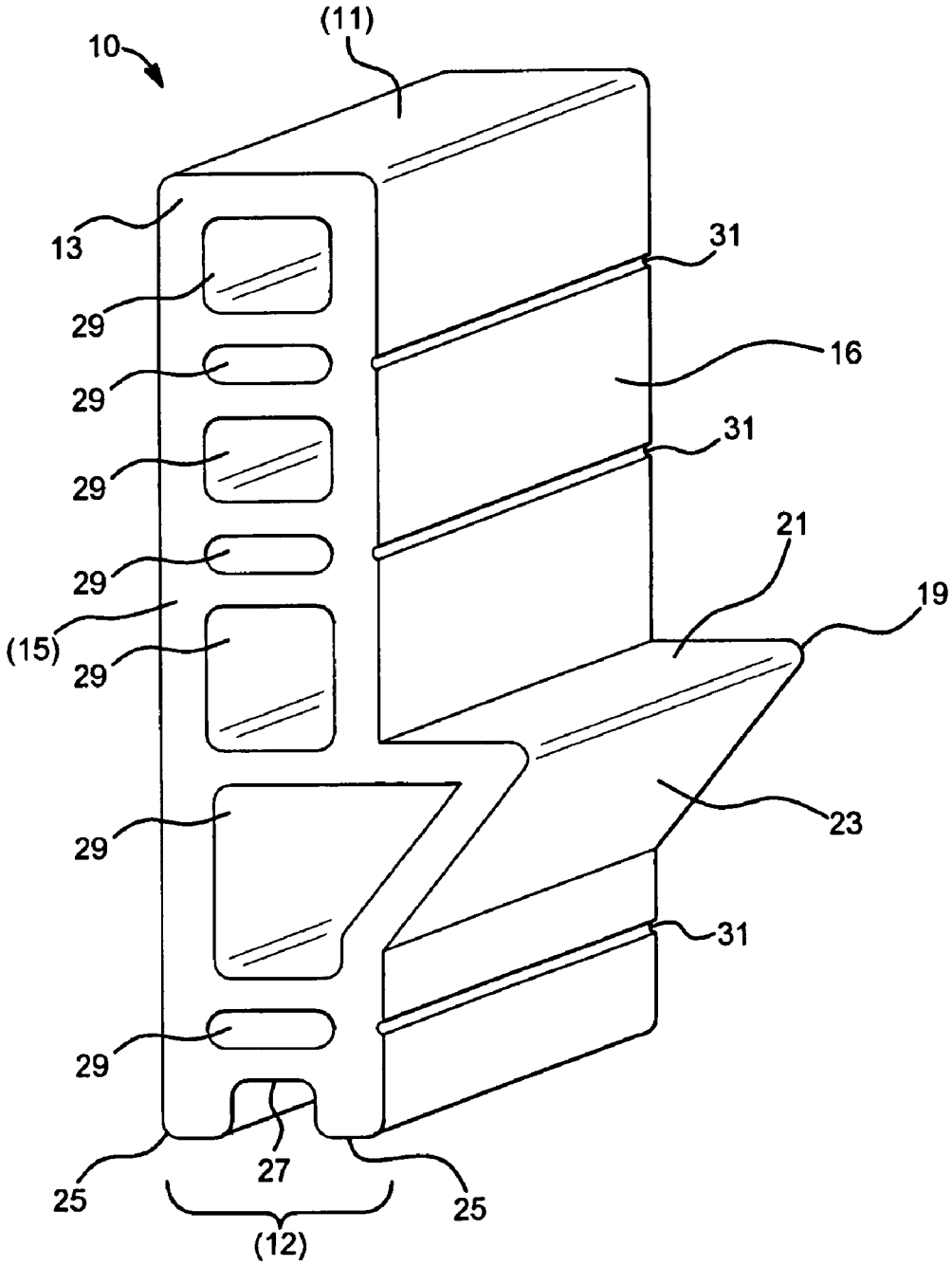
FIG. 3 illustrates a perspective view of the extruded composite grade board shown in FIG. 2.

FIG. 1 illustrates a cross-sectional side view of an extruded composite grade board 10 with an integrally formed ledge 19. The grade board 10 includes a body 13 having a top surface 11, a bottom surface 12, a back surface 15, and a front surface 16. As shown in FIGS. 1 & 3, the top surface 11 and bottom surface 12 extend in a generally horizontal direction and the back surface 15 and the front surface 16 extend in a generally vertical direction between the top surface 11 and the bottom surface 12. It is contemplated that the top surface 11, the bottom surface 12, the back surface 15, and the front surface 16 may also be of other configurations.

The top surface 11 and the back surface 15 are generally flat. The bottom surface 12 can include at least two legs 25 and a recessed portion 27, such as a groove, or any other configuration adapted to receive a tongue member of an extruded composite support board, as will be described herein. However, it is also contemplated that the bottom surface 12 can be flat.

The front surface 16 comprises an outwardly projecting ledge 19. The ledge 19 is integral to the body 13 of the grade board 10 and projects outwardly from the front surface 16. The ledge 19 is adapted to receive exterior trim, such as siding. The siding can be vinyl, steel, wood, or any other material as known to those of ordinary skill in the art. The integral ledge 19 has a top ledge surface 21 and a bottom ledge surface 23. As shown, the top ledge surface 19 is generally perpendicular to the front surface 16 and extends outwardly in a generally horizontal direction. The bottom ledge surface 23 extends outwardly at an angle of inclination relative to the front surface 16. As shown, the bottom ledge surface extends outwardly at an angle of inclination of about thirty degrees relative to the front surface 16; however, it is contemplated that other angles of inclination may be used, as known to those of ordinary skill in the art. In addition, it is noted that the bottom ledge surface 23 can be spaced apart from the top ledge surface 21 and be generally perpendicular to the front surface 16. In this configuration, a vertical side ledge surface (not shown) extends between the top ledge surface 21 and bottom ledge surface 23. As shown, the integral ledge 19 of the grade board 10 is made of the same composite material as the body 13 of the grade board 10 and is formed during the extrusion process forming the grade board 10.

The grade board 10 can be formed as a hollow grade board or grade board with hollow portions, as shown in FIG. 1, or as solid board (not shown). The hollow grade boards provide sufficient strength for a construction project while still having reduced density and weight. As illustrated in FIG. 1, the hollow grade board 10 has a plurality of spaced apart hollow portions 29 enclosed within the grade board 10. The grade board 10 has seven hollow portions, however, it is understood that any number of hollow portions may be utilized as required by a particular construction project. The hollow portion or portions may comprise from about 15% to 50% of the total composite grade board.

A plurality of spaced apart fastener guides 31 are provided in the front surface 16 of the board 10. As shown, each of the plurality of fastener guides 31 corresponds to one of the plurality of hollow portions 29 enclosed within the grade board 10. It is also contemplated that fastener guides 31 could be positioned at other locations of the board. The fastener guides 31 provide a location guide for the introduction of fasteners, such as screws, nails and other fasteners known by those of ordinary skill in the art to secure a grade board 10 to a post.

The grade board 10 described above may be made of various dimensions of length, width and height as will typically be governed by the particular use of the grade board 10. In one example, the grade board 10 is typically either an eight-foot or ten-foot board cut to a length sufficient to span the distance between adjacent posts. As shown in FIG. 1, the width of the grade board 10 is approximately one inch, as shown along line A-A. The height of the grade board 10 is approximately 7.25 inches, as shown along line B-B. The distance between the top surface 11 and the fastener guide 31(*a*) is 1.416 inches, as shown along line C-D. The distance between the fastener guides 31(*b*) is 1.417 inches, as shown along line D-E. The distance between the fastener guide 31(*b*) and the top ledge surface 21 is 1.417 inches, as shown along line E-F. The distance between the fastener guide 31(*c*) and the bottom surface 12 is 0.830 inches, as shown along line G-G. The distance between the bottom surface 12 and the top ledge surface 21 is three inches, as shown alone line K-K.

As shown, the plurality of hollow portions 29 are spaced apart from the front surface 16 by 0.312 inches, as shown along line H-H. Similarly, the plurality of hollow portions 29 is spaced apart from the back surface 15 by 0.312 inches. The plurality of hollow portions 29 are spaced apart from each other by 0.250 inches, as shown along line J-J.

The extruded composite grade board can be made from a variety of polymeric and cellulosic mixtures. Polymers suitable for manufacturing a grade board are exemplified by, but not limited to, polyethylenes, polypropylenes, polyvinylchloride homopolymers, polyvinylchloride copolymers, ethylene vinyl acetate copolymer, acrylonitrile-butadiene styrene, polystyrene, polyurethane, and polyesters. An example of a group of polymers that may be used are high density polyethylene (HDPE), low-density polyethylenes (LDPE), polyvinylchloride (PVC), polyvinylidene chloride (PVDC), chlorinated polyvinylchloride (CPVC), semi-rigid polyvinylchloride (S-RPVC), polypropylene (PP), ethylene vinyl acetate (EVA), and acrylonitrile-butadiene styrene (ABS) and polystyrene. A preferred group of polymers are high-density polyethylene and polyvinylchloride.

Cellulosic materials suitable for manufacturing the grade board are exemplified by, but not limited to, sawdust, wood particles, wood flour, wood fibers, wood chips, ground wood, wood flakes, wood veneers, wood laminates, paper, newspapers, alfalfa, wheat pulp, cardboard, straw, cotton, rice hulls, coconut shells, peanut shells, bagasse, plant fibers, bamboo fibers, palm fibers, and kenaf. A preferred group of cellulosic material is wood flour, sawdust, newspapers, wheat puff, wood chips, wood fiber, wood laminates, coconut shells, corn cobs and peanut shells. The most preferred cellulosic material is wood flour.

The relative percentages or amounts of the polymeric and cellulosic material of the composite may be chosen to achieve specific and desired characteristics of the composite. In a preferred range, the polymer may be present in an amount between about 30% and about 40% by weight, and the cellulosic material may be present in an amount between about 60% to about 70% by weight. In particular, the preferred range the polymer may be present in an amount between about 35% to about 40% by weight, the cellulosic material may be present between about 60% to about 65% by weight.

Additional ingredients including, but not limited to, inorganic fillers, cross-linking agents, lubricants, stabilizers, inhibitors, enhancers, weathering additives, colorants, process thermosetting material aids may be added to the composite. These additional ingredients may be present in the composite in an amount between about 2% to about 5% based on the total weight of the composite.

Prior to inclusion in the composite, the cellulosic material may be dried to a desired moisture content and stored in a moisture-free environment until needed.

Examples of inorganic fillers include talc, calcium carbonate, kaolin clay, magnesium oxide, titanium dioxide, silica, mica, barium sulfate, acrylics, and other similar, suitable, or conventional materials. Examples of lubricants include zinc stearate, calcium stearate, esters, amide wax, paraffin wax, ethylene bis stearamide, and other similar, suitable, or conventional materials. Examples of stabilizers include tin stabilizers, lead and metal soaps such as those of barium, cadmium, and zinc, and other similar, suitable, or conventional materials. Examples of process aids include acrylic modifiers, fatty acids, and other similar, suitable or conventional materials. In addition, examples of thermosetting materials include polyurethanes, such as isocyanates, phenolic resins, unsaturated polyesters, epoxy resins, and other similar, suitable, or conventional materials. Combinations of the aforementioned materials are also examples of thermosetting materials. Board can be milled from a single piece of wood.

Figure 2:
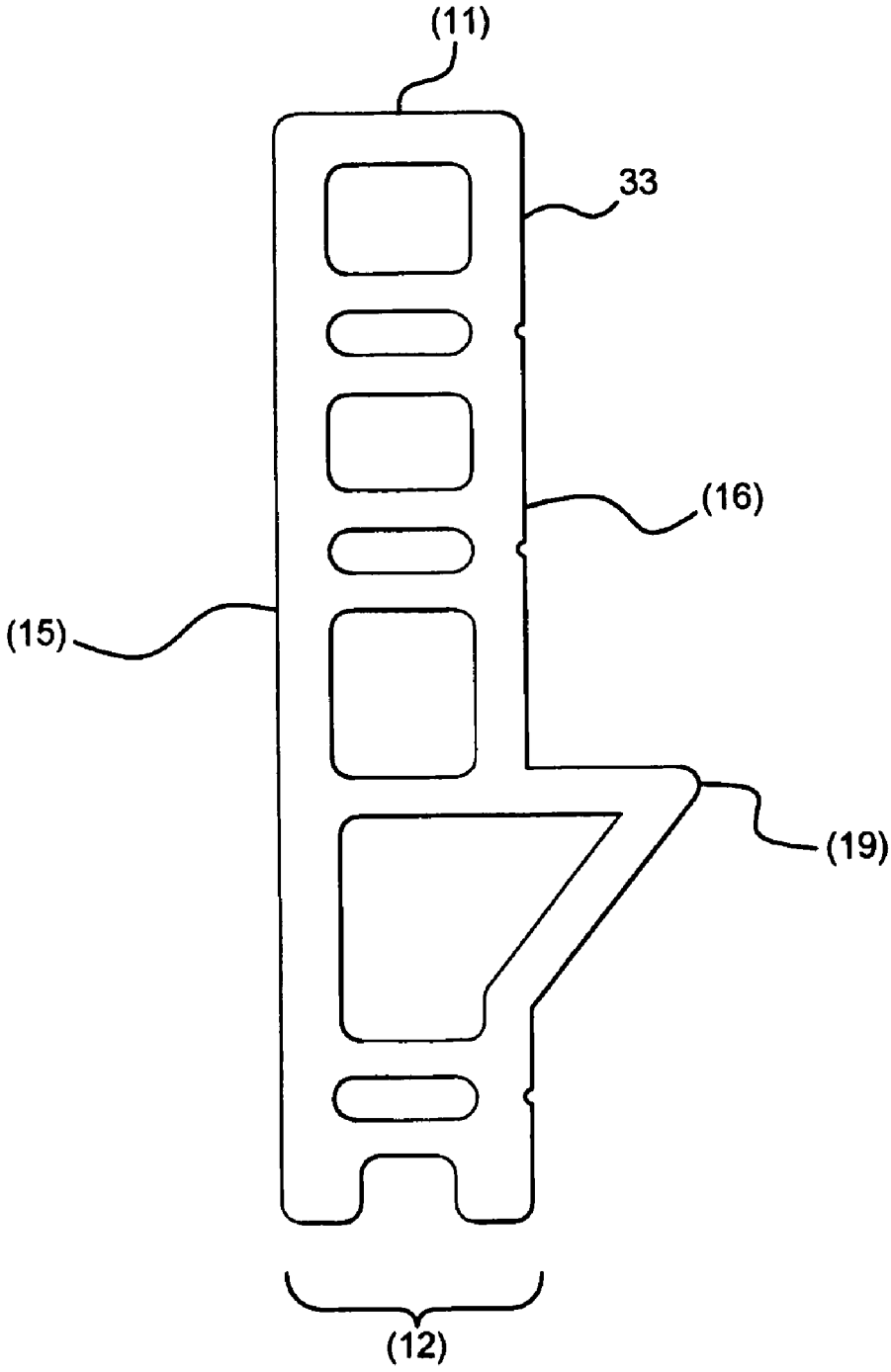
FIG. 2 illustrates a cross-sectional side view of the extruded composite grade board shown in FIG. 1 with a polymeric skin.

As illustrated in FIG. 2, the grade board 10 may further include a polymer skin 33 around the perimeter of the body 13 of the board 10. The skin 33 helps provide a maintenance free grade board 10. The polymer skin 33 may be used to add color, UV protection, strengthening additives and/or other additives to provide additional protection from rotting, cracking, or warping. If the skin 33 is co-extruded with the board 10, the polymer skin 33 may be made of the same polymer type used to fabricate the extruded composite grade board 10, as described above. Alternatively, the skin 33 may be made of a different polymer than is used in the body and then attached to the body by an adhesive.

Figure 4:
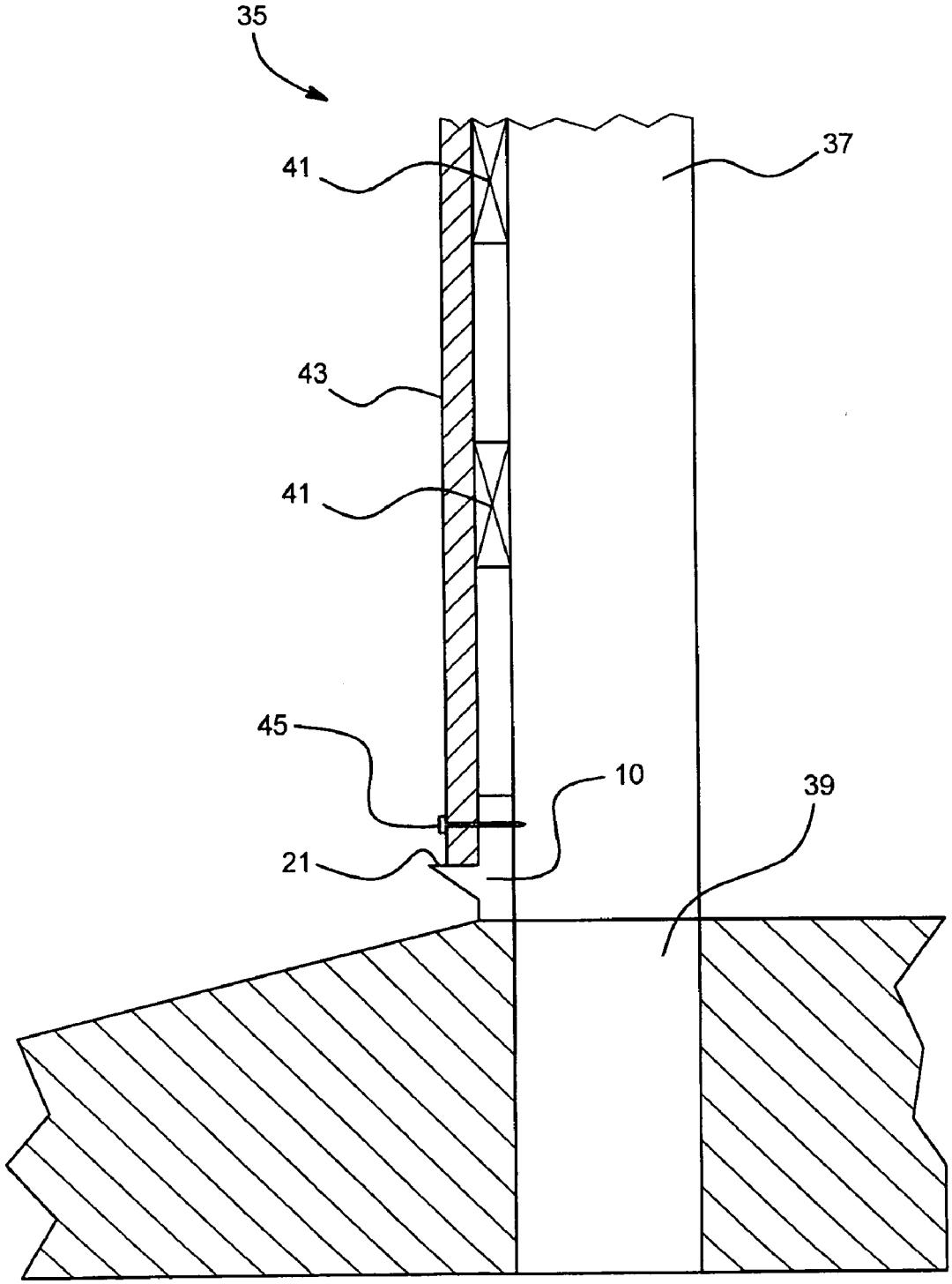
FIG. 4 illustrates an example of the extruded composite grade board secured to a post.

The grade board 10 is typically used in any construction project requiring the use of a grade board, including, but not limited to, a post frame building, a shed, a garage, trailer skirting, or an out building. A portion of a post frame building 35 is illustrated in FIG. 4. The post frame building 35 has a post 37 set in a posthole 39. The post 37 is typically a 4-inch by 4-inch post and maybe formed of laminated boards. Typically, the entire post 37 is treated or at least the portion of the post that is disposed below grade is treated. In order to resist withdrawing the post 37 from the posthole 39, the post 37 is sunk into a concrete footing formed at the bottom of the posthole 39.

A plurality of spaced apart sideboards 41 are disposed along the outside margin of the post 37. Each of the sideboards 41 typically extends between adjacent posts 37 forming the periphery of the post frame building 35. Generally, the sideboards 41 are vertically spaced three to four feet apart and are of the same width as the grade board 10. The grade board 10 and sideboards 41 provide the principal structure for securing the exterior trim 43 to the post frame building 35.

The grade board 10 is disposed at grade level. Grade is typically measured at the bottom margin of the grade board 10 and soil is then mounded up slightly on the exterior margin of the grade board 10 in order to provide a slope to facilitate drainage away from the post frame building 35. As noted above, grade board 10 is typically either an eight or ten foot board cut to a length sufficient to span the distance between adjacent posts 37. The grade board 10 is secured to the adjacent posts 37 by use of a fastener. Preferably, the fastener extends through the fastener guides 31 and corresponding hollow portion 29 into adjacent posts 37.

Exterior trim 43 is fastened to the grade board 10 and sideboards 41 to form the exterior walls of the post frame building 35. Typically, the exterior trim 43 is formed of a ferric material in sheets that are usually three to four feet wide and as high as the wall height of the post frame building 10. The bottom portion of the exterior trim 43 usually rests on the top ledge surface 21 of the grade board. The exterior trim 43 can be secured to the adjacent post 37 by the fastener 45 extending through the grade board 10 into the posts 37. Preferably, the fastener extends through the fastener guides 31 and corresponding hollow portion 29 into the adjacent post 37. It is also contemplated that a first fastener, as described above, secures the grade board 10 to the adjacent post 37 and the second fastener 45 secures the exterior trim 43 to the grade board 10 and the adjacent post 37.

Figure 5:
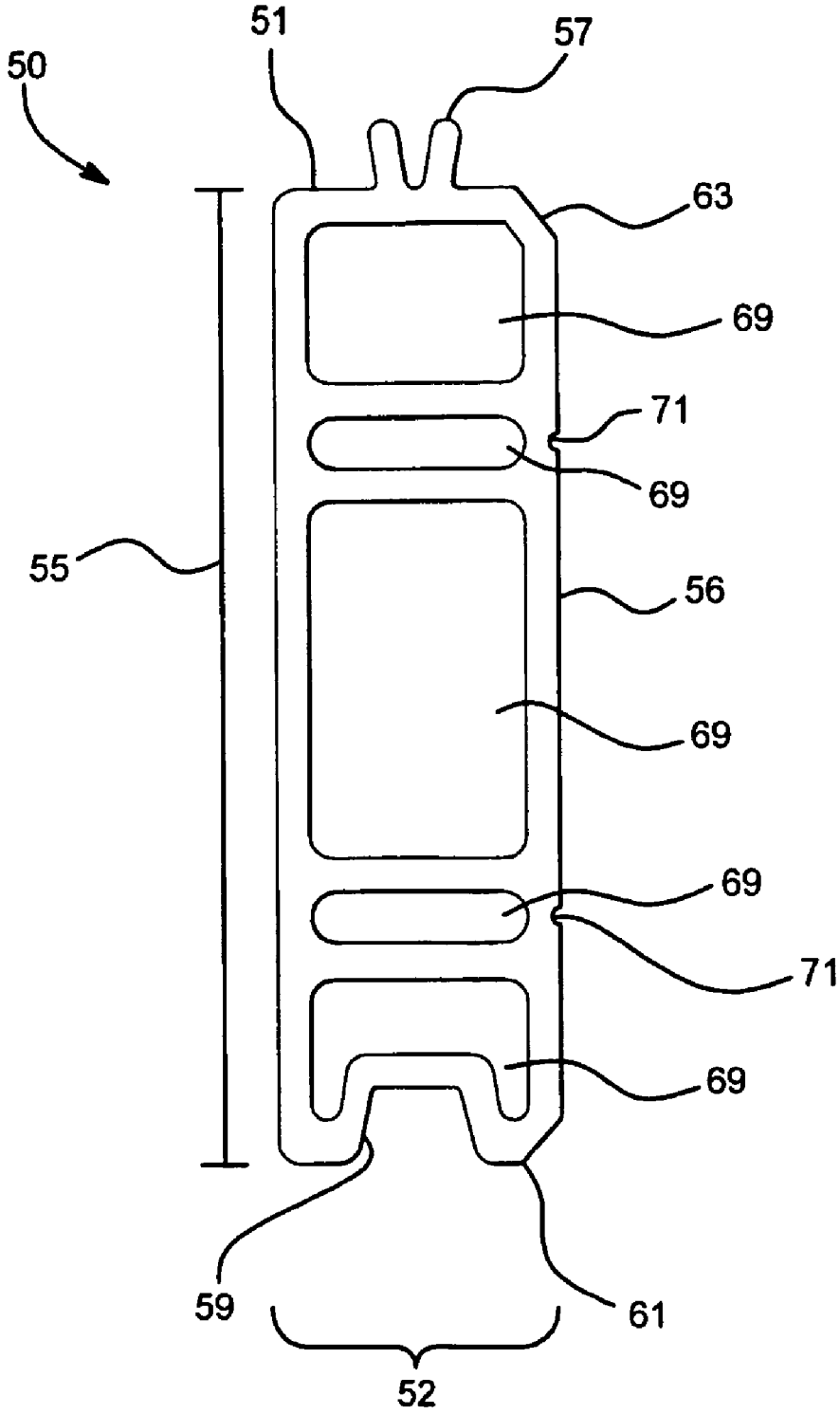
FIG. 5 illustrates a cross-sectional side view of an extruded composite support board which may be used to secure the extruded composite grade board shown in FIGS. 1 & 2 to unleveled ground; and, FIG. 6 illustrates the extruded composite grade board of FIG. 2 secured to the extruded composite support board of FIG. 5.

Often times, a post frame building is constructed on unleveled ground and the grade line and grade board 10 is above a portion of the ground. Referring to FIG. 5, a tongue and groove design support board 50 can be placed underneath the extruded grade board 10 in order to ensure structural integrity of the post frame building. Preferably, the support board 50 is made from the variety of polymeric and cellulosic mixtures used to fabricate the grade board 10, as described above.

As shown, the support board 50 has a body 53 having a top surface 51, a bottom surface 52, a back surface 55, and a front surface 56. As with the grade board 10 described above, preferably, the top surface 51 and bottom surface 52 of the support board 50 extend in a generally horizontal direction and the back surface 55 and the front surface 56 extend in a generally vertical direction between the top surface 51 and the bottom surface 52. It is contemplated that that the top surface 51, the bottom surface 52, the back surface 55, and the front surface 16 may also be of other configurations.

The top surface 51 has a tongue member 57 adapted to securely engage the recess 27 disposed on the bottom surface 12 of the grade board 10. The bottom surface 52 of the support board 50 has at least two legs 61 and a recess 59, such as a groove, adapted to receive a tongue member 57 of another support board 50. However, it is also contemplated that the bottom surface 12 can be flat. The back surface 55 and the front surface 56 are generally flat. The top portion of the front surface 56 may include a beveled surface 63 at the intersection of the top surface 51 and the front surface 56.

As with the grade board 10, the support board 50 can be formed as a solid board or as a hollow board having one or more hollow portions. As illustrated in FIG. 5, the support board comprises a plurality of spaced apart hollow portions 69 enclosed within the body 53 of the support board 50. As shown, the support board 50 has five hollow portions, however, it is understood that any number of hollow portions may be utilized as required by a particular construction project.

Similar to the hollowed grade board 10, the front surface 56 of the support board 50 has a plurality of spaced apart fastener guides 71. Each of the plurality of fastener guides 71 corresponds to one of the plurality of hollow portions 69 enclosed within the support board 50. The fastener guides 71 provide for the introduction of fasteners, such as screws, nails and other fasteners known by those of ordinary skill in the art to secure the support board 50 to a post.

Figure 6:
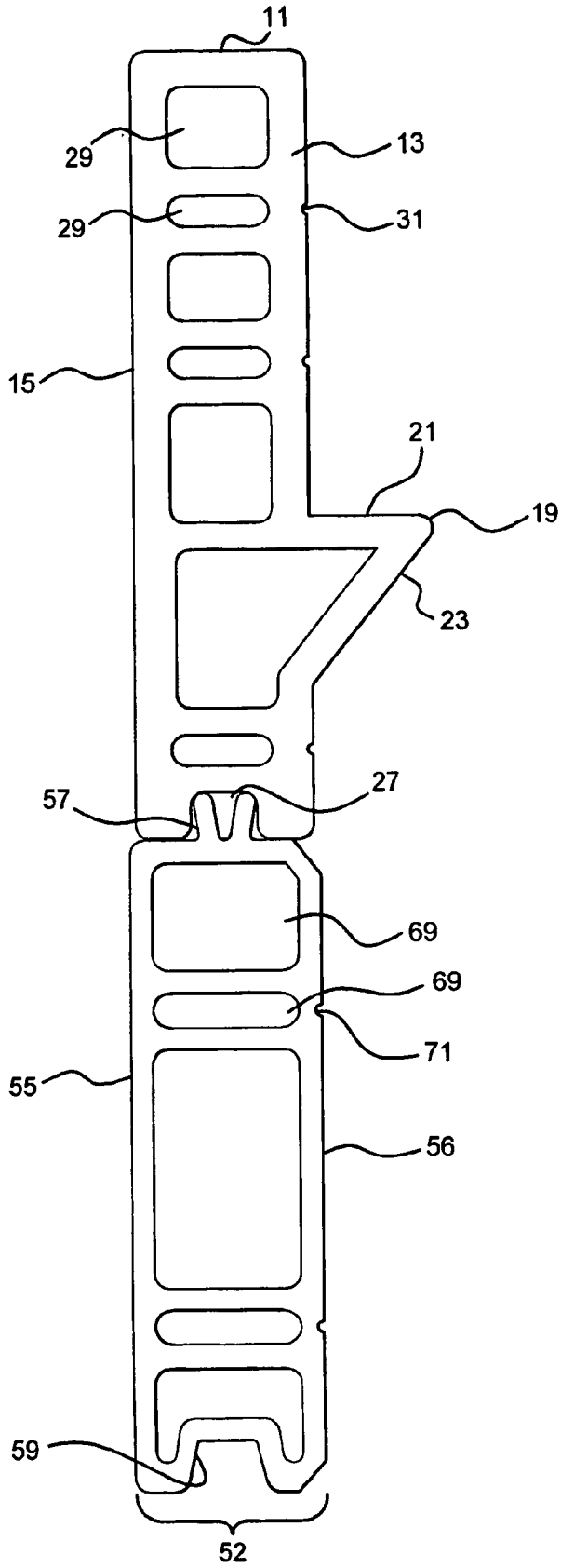

As shown in FIG. 6, the support board 50 is placed underneath the grade board 10 in order to ensure the structural integrity of the post frame building. The tongue 57 on the support board 50 engages the recess 27 on the bottom surface 12 of the grade board 10 and interlocks the support board 50 with the grade board 10. If needed, additional tongue and groove design boards can be interlocked with the support board 50. A tongue on the additional tongue and groove design board engages the recess 59 disposed on the bottom surface 52 of the support board 50 shown in FIG. 6. Preferably, the tongue 57 on the support board 50 engages the recess 27 on the grade board 10 such that the first side surface 15 of the grade board 10 is flush with the back surface 55 of the support board 50 and the second side surface 16 of the grade board 10 is flush with the front surface 56 of the support board 50.

The grade board 10 and support board 50 may be fabricated as follows:

The composite material may be produced by separately preparing the plastic and cellulosic materials. The cellulosic filler material is generally dried and stored in a moisture free environment until needed. The plastic component, including the resin, and any inorganic fillers, lubricants, or other additives are preferably combined in a mixer or blender. Alternatively, the plastic resin, cellulosic filler material and other components may be fed into a compounder in proper ratios.

The compounder mixes and melts the individual components into a homogeneous reinforced composite material, and at the same time removes moisture from the filler component. It is important that during the mixing of the reinforced material that the cellulosic filler material become sufficiently coated by the plastic resin. Wood flour and similar materials are generally preferred over wood fiber and other larger particle size fillers because of its finer particle size, resulting in a better mix with the plastic resin. The compounder can feed directly into a finish extruder in which case a transition chute or similar device is preferably provided to guide the material from the compounder into the molding machine. The reinforced composite material travels through the compounder, the transition chute and the molding machine, through a die at about 350 degrees. The die includes a die orifice having a cross sectional shape corresponding to that of the particular board 10, 50 that is being fabricated. While still in the die, the board 10, 50 may be co-extruded or covered with a thin outer film or skin adding color, UV protection and/or strengthening additives. As the heated core material is extruded through the die into ambient atmospheric conditions at normal room temperature, some cooling effect takes place before entering a rectangular cooling tank with water spray nozzles spaced along the length of the cooling tank. This tank also houses the vacuum sizer and calibrator to assure the extruded shape during cooling. As the product is passed through the tank the temperature of the core is reduced. There are 3 cooling tanks in line spaced approximately 12 inches apart. Only the first tank includes the sizer and calibrator. The formed and cooled part is then passed through a device including opposed, motor driven, endless conveyor belts (the puller) which is coordinated to the rate at which the extruder is extruding the core part so that the core part will not buckle or be stretched out of its shape. The formed part will then pass through a cut-off saw, which will cut the board into usable lengths. Many packaging techniques can be used to stack or package the boards.

While the specific examples have been illustrated and described, numerous modifications come to mind without significantly departing from the spirit of the invention, and the scope of protection is only limited by the scope of the accompanying Claims.

What is claimed is:

1. An extruded composite grade board comprising:

a body comprising a top surface, a bottom surface, a front surface, and a back surface, the body extending in a longitudinal direction from the top surface to the bottom surface;

seven hollow portions positioned along the longitudinal direction within the body, wherein the hollow portions are spaced apart from the front surface in a direction perpendicular to the longitudinal direction;

a ledge integral to the body and projecting outwardly from the front surface, the ledge having a top ledge surface and a bottom ledge surface, wherein the top ledge surface is perpendicular to the front surface, and the bottom ledge extends outwardly at an angle of inclination of about 30 degrees from the front surface;

at least one fastener guide comprising a groove disposed on the front surface, wherein the at least one fastener guide is aligned in the direction perpendicular to the longitudinal direction with one of the hollow portions within the body;

a tongue member integral to the body and projecting outwardly from the bottom surface, the tongue member being dimensioned to engage a recess member portion of an extruded composite grade board; and a skin encasing the body, wherein the skin comprises a polymer in the composite;

wherein the front surface is spaced apart from and parallel to the back surface;

wherein the bottom surface further comprises a recess dimensioned to receive a tongue member portion of an extruded composite support board;

wherein the composite comprises a blend of about 35% to 40% of high density polyethylene, about 60% to 65% of sawdust, and about 2% to 5% processing additives;

wherein the processing additives are selected from a group consisting of inorganic fillers, cross-linking agents, lubricates, stabilizers, inhibitors, weathering additives, colorants, and process aids; and wherein the seven hollow portions comprise from about 15% to 50% of the total composite grade board.

* * * * *